US006613722B1

(12) United States Patent
Watts et al.

(10) Patent No.: US 6,613,722 B1
(45) Date of Patent: Sep. 2, 2003

(54) LUBRICATING COMPOSITION

(75) Inventors: Raymond F. Watts, Long Valley, NJ (US); Philip Reeve, Grove (GB)

(73) Assignee: Exxon Chemical Patents Inc., Wilmington, DE (US)

( * ) Notice: Subject to any disclaimer, the term of this patent is extended or adjusted under 35 U.S.C. 154(b) by 875 days.

(21) Appl. No.: 08/813,530

(22) Filed: Mar. 7, 1997

(51) Int. Cl.[7] ..... C10M 141/10

(52) U.S. Cl. ..... 508/195; 508/291; 508/434; 508/436; 508/441; 508/442; 508/554; 508/562

(58) Field of Search ..... 508/554, 195

(56) References Cited

U.S. PATENT DOCUMENTS

| | | | | | |
|---|---|---|---|---|---|
| 3,197,405 | A | * | 7/1965 | LeSuer | 508/349 |
| 3,254,025 | A | * | 5/1966 | LeSuer | 508/192 |
| 3,382,172 | A | * | 5/1968 | Lowe | 508/512 |
| 3,502,677 | A | * | 3/1970 | LeSuer | 508/227 |
| 3,793,199 | A | * | 2/1974 | Schlicht | 508/436 |
| 4,704,217 | A | | 11/1987 | Sweeney et al. | 252/32.7 |
| 4,717,490 | A | | 1/1988 | Salentine | 252/32.7 |
| 5,078,893 | A | * | 1/1992 | Ryer et al. | 508/195 |
| 5,242,612 | A | | 9/1993 | Ryer et al. | 252/46.7 |
| 5,320,768 | A | * | 6/1994 | Gutierrez et al. | 508/195 |
| 5,391,307 | A | | 2/1995 | Yamazaki et al. | 252/32.5 |
| 5,536,423 | A | | 7/1996 | Miyagawa et al. | 508/436 |
| 5,641,732 | A | * | 6/1997 | Bloch et al. | 508/554 |
| 5,641,733 | A | * | 6/1997 | Bloch et al. | 508/554 |
| 5,646,099 | A | * | 7/1997 | Watts et al. | 508/554 |
| 5,665,685 | A | * | 9/1997 | Takigawa | 508/436 |

FOREIGN PATENT DOCUMENTS

| | | |
|---|---|---|
| EP | 0286996 | 10/1988 |
| EP | 0348236 | 12/1989 |
| EP | 0407124 | 1/1991 |
| EP | 0453114 | 10/1991 |

* cited by examiner

*Primary Examiner*—Ellen M. McAvoy

(57) ABSTRACT

A lubricating composition for lubricating a continuously variable transmission, the lubricating composition comprising a mixture of a major amount of a lubricating oil and an effective amount of a performance enhancing additive combination comprising: (a) at least one organic phosphite; (b) at least one amine salt of an organic phosphate; and (c) one or more friction modifiers selected from the group consisting of selected (1) amides, (2) succinimides, and (3) ethoxylated amines.

18 Claims, No Drawings

LUBRICATING COMPOSITION

FIELD OF THE INVENTION

This invention relates to a composition and a method for lubricating a steel belt continuously variable transmission (CVT).

BACKGROUND OF THE INVENTION

The continuing pursuit of more fuel efficient motor vehicles has led to the development of continuously variable transmissions by a number of manufacturers. The major difference between a continuously variable transmission and a conventional automatic transmission is that automatic transmissions use planetary gear sets to accomplish speed changes, whereas a continuously variable transmission uses pulleys and a belt to change speed. A conventional automatic transmission normally has 3, 4 or 5 fixed reduction ratios or "speeds", e.g., a 5-speed automatic transmission. The operating system of the transmission selects the appropriate reduction ratio, or speed, based on engine rpm, ground speed and throttle position. In a continuously variable transmission an almost infinite number of reduction ratios, within fixed limits, can be achieved by changing the relative radius of travel of the driving belt on the driving and driven pulleys.

The critical mechanism in the CVT is the variator. The variator is composed of two steel pulleys and a steel belt. The pulleys can be opened and closed thereby allowing the belt to travel at different radiuses. When the driving pulley is fully opened (small radius of belt travel) and the driven pulley is fully closed (large radius of belt travel) very high reduction ratios are achieved (yielding low ground speeds). Conversely when the driving pulley is fully closed (large radius of belt travel) and the driven pulley is fully opened (small radius of belt travel) increases in output speed over input speed are achieved. (yielding high ground speeds).

The novelty of this design is that the belt is made of steel. Two types of CVT transmissions exist. In one design, the belt is "pushed" or compressed to transmit power, and in the other the belt is pulled, as is more common with a V-belt. Since steel belts are used in contact with steel pulleys, the lubrication requirements are identical for both design types.

There are two critical requirements for the lubricants used in CVT transmissions: (1) control of wear and (2) control of friction. Since steel-on-steel coefficients of friction tend to be very low, e.g., 0.03 to 0.2, extremely high closing forces are applied to the pulley sides to keep the belt from slipping. Any slippage of the belt causes catastrophic wear which quickly leads to failure. The pulleys are made to exacting limits and have a precise surface finish to allow optimum operation. No wear of these surfaces can be allowed. Therefore, an appropriate lubricant must have excellent wear control. The frictional characteristics of the belt-pulley. interface are also critical. The friction must be very high to prevent slippage of the belt during transmission of high torque from the engine to the drive wheels. Too high a static coefficient of friction, however, can cause "sticking" of the belt which will lead to oscillation and audible noise in the passenger compartment of the vehicle. This "whistling" of the belt is highly undesirable.

We have now found a unique combination of antiwear additives and friction modifiers that solve the difficult lubrication problems created by the steel-on-steel pulley system used in a continuously variable transmission.

SUMMARY OF THE INVENTION

This invention relates to a composition and a method of lubricating a continuously variable transmission comprising:

(1) a major amount of a lubricating oil; and (2) an effective amount of a performance enhancing additive combination comprising:
- (a) an organic phosphite;
- (b) an amine salt of an organic phosphate; and
- (c) one or more friction modifiers chosen from:
  - (1) selected amides,
  - (2) succinimides, and
  - (3) ethoxylated amines.

DETAILED DESCRIPTION OF THE INVENTION

Lubricating the variator system of a CVT is not a simple matter. It presents a unique problem of controlling wear and friction to very exacting limits. The antiwear agents must be carefully selected to provide excellent wear control and yet not interfere with the friction modifiers. The friction modifiers must be selected so as to provide very precise control of the steel-on-steel friction and not interfere with the control of wear.

1. Lubricating Oils

Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require the lubricating oil or lubricating oil mixture to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000 to 1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly oligomers of 1-decene.

2. Additive Composition a. Organic Phosphites

The lubricating oil is combined with an additive formulation. One component of the additive system of the current invention is an organic phosphite. The organic phosphites useful in this invention are the mono-, di- and trihydrocarbyl phosphites having the structures I and IA, where structures I and IA are represented by:

Structure I

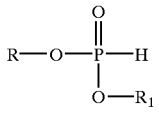

where R is hydrocarbyl and $R_1$ is hydrocarbyl or hydrogen;

Structure IA

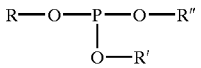

where R, R', and R" are hydrocarbyl. As used herein, the term "hydrocarbyl" denotes a group having a carbon atom directly attached to the remainder of the molecule and having predominantly hydrocarbon character within the context of this invention. Such groups include the following: (1) hydrocarbon groups; that is, aliphatic, alicyclic (e.g., cycloalkyl or cycloalkenyl), aromatic groups, alkaryl groups, and the like, as well as cyclic groups wherein the ring is completed through another portion of the molecule; (2) substituted hydrocarbon groups; that is, groups containing non-hydrocarbon substituents which in the context of this invention, do not alter the predominantly hydrocarbon nature of the group. Those skilled in the art will be aware of suitable substituents. Examples include, halo, hydroxy, nitro, cyano, alkoxy, acyl, etc.; (3) hetero groups; that is, groups which while predominantly hydrocarbon in character within the context of this invention, contain atoms of other than carbon in a chain or ring otherwise composed of carbon atoms. Suitable hetero atoms will be apparent to those skilled in the art and include, for example, nitrogen, oxygen and sulfur.

In structures I and IA, when R, $R_1$, R', or R" is alkyl, the alkyl groups are $C_4$ to $C_{20}$, preferably $C_6$ to $C_{18}$, most preferably $C_8$ to $C_{16}$. When R, $R_1$, R', or R" is aryl, the aryl groups consist of from 6 to 30 carbon atoms, preferably $C_6$ to $C_{12}$, and contain at least one unsaturated "aromatic" ring structure. Such groups are known to those skilled in the art. Examples include methyl, ethyl, octyl, decyl, octadecyl, cyclohexyl and phenyl, etc. R, $R_1$, R', and R" can also vary independently. As stated, R, $R_1$, R', and R" can be alkyl, aryl, may be linear or branched, and the aryl groups may be phenyl or substituted phenyl. The R, $R_1$, R', and R" groups may be saturated or unsaturated, and they may contain hetero atoms such as S, N or O. The preferred materials are the dialkyl phosphites (structure I). The R and $R_1$ groups are preferably linear alkyl groups such as butyl, octyl, decyl, hexadecyl and octadecyl. The most preferred are decyl, undecyl, 3-thiaundecyl, pentadecyl and 3-thiapentadecyl.

Phosphites of structures I and IA may be used individually or in mixtures.

Another embodiment of this invention is the use of the mixed alkyl phosphites described in U.S. Pat. Nos. 5,185,090 and 5,242,612.

While any effective amount of the organic phosphite may be used to achieve the benefits of the invention, typically these effective amounts will be from 0.01 to 5.0 mass percent in the finished fluid. Preferably the treat rate in the fluid will be from 0.2% to 3.0% and most preferred is 0.3% to 1.0%.

Examples for producing representative mixed organic phosphites are given below.

EXAMPLE P-1-A

An alkyl phosphite mixture was prepared by placing in a round bottom 4-neck flask equipped with a reflux condenser, a stirring bar and a nitrogen bubbler, 246 grams (1 mol) of hydroxyethyl-n-dodecyl sulfide, 122 grams (1 mol) of thiobisethanol, and 194 grams (1 mol) of dibutyl phosphite. The flask was flushed with nitrogen, sealed and the stirrer started. The contents were heated to 95° C. under vacuum (−60 kPa). The reaction temperature was maintained at 95° C. until approximately 59 mL of butyl alcohol were recovered as overhead in a chilled trap. Heating was continued until the TAN (Total Acid Number) of the reaction mixture reached about 110. This continued heating took approximately 3 hours, during which time no additional butyl alcohol was evolved. The reaction mixture was cooled and 102 grams of a baseoil sold under the trademark Necton-37® and available from Exxon Chemical Co., was added. The final product was analyzed and found to contain 5.2% phosphorus and 11.0% sulfur.

EXAMPLE P-1-B

An alkyl phosphite mixture was prepared by placing in a round bottom 4-neck flask equipped with a reflux condenser, a stirring bar and a nitrogen bubbler, 190 grams (1 mol) of hydroxyethyl-n-octyl sulfide, 154 grams (1 mol) of dithiodiglycol, and 194 grams (1 mol) of dibutyl phosphite. The flask was flushed with nitrogen sealed and the stirrer started. The contents were heated to 105° C. under vacuum (−90 kPa). The reaction temperature was maintained at 105 to 110° C. until approximately 54 mL of butyl alcohol were recovered as overhead in a chilled trap. Heating was continued until the TAN of the reaction mixture reached about 70. This continued heating took approximately 3 hours, during which time no additional butyl alcohol was evolved. The reaction mixture was cooled and analyzed for phosphorus and sulfur. The final product contained 6.4% phosphorus and 19.7% sulfur.

b. Amine Salts of Organic Phosphates

The second component of the additive system of the present invention is an amine salt of an organic phosphate. The formulas of the amine salts of organic phosphates useful in the lubricants of the present invention are shown as structure II:

Structure II

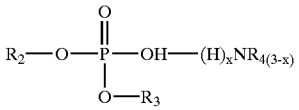

wherein $R_2$ and $R_3$ are alkyl or aryl, and further $R_3$ may be H; and $R_4$ is alkyl. The amine salts are selected so as to be soluble in the lubricating composition. A preferred method of preparing the compounds having structure II is to react at least one hydroxy compound of the formula ROH, where R is a hydrocarbyl group, with phosphorus pentoxide ($P_2O_5$). The phosphorus-containing compositions obtained in this manner are mixtures of phosphorus compounds, and are generally mixtures of mono- and disubstituted phosphoric acids (phosphates).

The hydroxy compounds used in the preparation of the organic phosphates of this invention are characterized by the formula ROH wherein R is a hydrocarbyl group. The hydroxy compound reacted with the phosphorus pentoxide may comprise a mixture of hydroxy compounds of the formula ROH where the hydrocarbyl group R contains from 1 to 30 carbon atoms. It is necessary that the amine salt of the substituted phosphoric acid composition ultimately prepared is soluble in the lubricating composition of the present invention. Preferably the hydrocarbyl group R will contain at least 4 carbon atoms and, most preferably, at least about 8 carbon atoms. The preferred alcohols are the aliphatic alcohols and, more particularly, the primary aliphatic alcohols containing at least about 4 carbon and preferably about 8 carbon atoms. Accordingly, examples of preferred alcohols include 1-octanol, 2-ethyl-hexyl alcohol, 1-decanol, 1-dodecanol and 1-hexadecanol. Other preferred type of alcohol reactants are the primary linear alcohols containing one sulfur linkage. Examples of these materials would include 3-thianonanol, 3-thiaundecanol and 3-thiapentadecanol.

The molar ratio of the hydroxy compound ROH to phosphorus pentoxide should be within the range of from about 1:1 to 1:8, the preferred range being about 3:1 to 6:1. The reaction may be brought about by mixing the two reactants at elevated temperatures above about 50° C. Preferably the temperature is between 50° C. and 150° C., and usually below about 100° C. The reaction may be carried out in a solvent or neat.

The amine salts of the present invention can be prepared by reacting the phosphates described above with at least one amine compound which may be a primary, secondary or tertiary amine. Preferably the amines which are reacted with the substituted phosphoric acids to form the amine salts are primary or secondary hydrocarbyl amines having the general formula:

H—NR'R"

wherein R' is a hydrocarbyl group and R" is hydrogen or a hydrocarbyl group. Generally these hydrocarbyl groups R' and R" will contain up to about 150 carbon atoms each and will preferably be aliphatic groups containing from about 4 to about 30 carbon atoms.

In one embodiment, the hydrocarbyl amines which are used in preparing the amine salts of the present invention are primary hydrocarbyl amines containing from about 4 to about 30 carbon atoms in the aliphatic group, more preferably from about 8 to about 20 carbon atoms, and most preferably from 10 to 18 carbon atoms. Typical amines include alkyl amines such as n-hexylamine, n-octylamine, n-decylamine, n-octadecylamine. The invention also includes mixtures of these amines.

In another embodiment, the amine salts of the composition of this invention are derived from tertiary-aliphatic primary amines having at least about 4 carbon atoms in the alkyl group. Usually the tertiary aliphatic amines are monoamines represented by the formula:

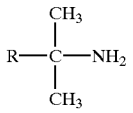

wherein R is a aliphatic group containing from one to about 30 carbon atoms. Such amines would include tertiary butyl amine, tertiary octyl primary amine, tertiary octadecyl primary amine. Mixtures of such amines are also satisfactory and often preferred. Such mixtures are sold commercially under the trademark Primene 81R® (a mixture of $C_{11}$ to $C_{14}$ tertiary alkyl primary amines) and under the trademark Primene JM-T® (a mixture of $C_{18}$ to $C_{22}$ tertiary alkyl primary amines), and both of these products are available from the Rohm & Haas Corporation.

Secondary amines include dialkyl amines having two of the above included alkyl groups. The secondary amines need not be symmetrical, i.e. , R' and R" may be different, and further, R" may bear other non-reactive substituents such as nitrile, carbalkoxy, amide, ether, thioether, etc. Examples of such amines include butyl, n-hexyl amine, dihexyl amine, di-octyl amine, etc.

A further class of secondary amines are the "Duomeens" in which R' is long chain alkyl group and R" is —$CH_2CH_2NH_2$. Examples of these products include N-coco-1,3-diaminopropane, N-oleyl-1,3-diaminopropane.

A particularly useful class of amine salts of a phosphates is prepared as described in U.S. Pat. No. 3,197,405 which is hereby incorporated by reference. These materials are prepared by neutralizing with an amine, the acid formed by reacting a hydroxy-substituted phosphorothioc acid triester with an inorganic phosphorus acid or halide. In this case, the primary alcohol group reacted with the phosphorus pentoxide has the formula:

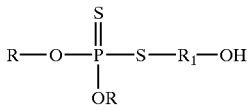

where R is $C_2$ to $C_{16}$ alkyl, and $R_1$ is $C_1$ to $C_{10}$ alkyl.

While any effective amount of the amine salt of the phosphate may be used to achieve the benefits of this invention, typically these effective amounts will be from about 0.01 to 5.0 mass percent in the finished fluid. Preferably the dosages will be from about 0.1 to 3.0 mass percent and more preferably from 0.2 to 1.0 mass percent.

Examples of methods for producing amine salts of the organic phosphates are given below.

EXAMPLE P-2-A

Into a suitable vessel equipped with a stirrer, nitrogen sparger and condenser were charged 2211 grams of Exxon solvent 75 neutral oil. The oil was vigorously stirred and sparged with nitrogen at room temperature while 284 grams (2.0 mol) of phosphorus pentoxide was added. Over a period of about one hour, 2280 grams (12 mol) of hydroxyethyloctyl sulfide was added. During this addition the temperature of the mixture rose approximately 20° C. At the completion of the addition, the temperature in the vessel was raised to about 75° C. and held constant for four hours. The reaction mass was cooled and filtered to yield 4770 grams of product. The product was analyzed and found to contain 8.44% sulfur and 2.51% phosphorus. The material had a TAN of 29.7.

One kilogram of the above product was returned to the reactor and treated with Primene 81R (a tertiary alkyl primary amine with 11 to 14 carbon atoms) (approximately 100 grams) until just neutral. The resulting product was analyzed and found to contain 7.6% sulfur and 2.2% phosphorus.

EXAMPLE P-2-B

Into a suitable vessel equipped with a stirrer, nitrogen sparger and condenser, was placed 380 grams (1.0 mol) of hydroxypropyl-O,O-di-(4-methyl-2-pentyl) phosphorodithioate. The vessel was flushed with nitrogen, the stirrer started and the contents heated to approximately 60° C. Phosphorus pentoxide, 47.5 grams (0.33 mol) was added over about 30 minutes. At the completion of the addition the mixture was heated to about 75° C. and held at that temperature for about 2 hours. The product was cooled and filtered to yield the phosphate ester. To a portion of the product, 217 grams (0.5 mol) was added, with stirring, 66 grams (0.35 mol) of a commercial primary amine, Primene 81-R. The partially neutralized phosphate had a TAN of 26 and contained 10.2% phosphorus.

c. Friction Modifiers (1) Amides

The amide friction modifiers useful in the current invention are those having the structure III:

Structure III

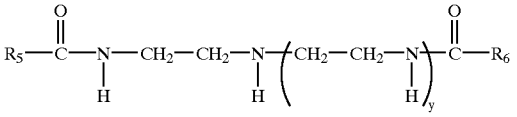

wherein $R_5$ and $R_6$ are independently $C_9$ to $C_{29}$ alkyl groups, and y=1 to 10.

One type of friction modifier useful with this invention is the reaction product of a polyamine and a carboxylic acid or anhydride. The polyamine reactant contains from 2 to 60 total carbon atoms and from 3 to 15 nitrogen atoms with at least one of the nitrogen atoms present in the form of a primary amine group and at least two of the remaining nitrogen atoms present in the form of primary or secondary amine groups. Additional suitable amines include polyoxyalkylene polyamines such as polyoxypropylene triamines and polyoxyethylene triamines. The preferred amines are polyamines of having the structure VI:

Structure VI

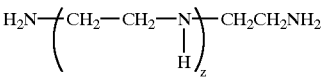

where z is an integer from 1 to 10, preferably from 1 to 3.

These include common polyethylene amines such as diethylene triamine (DETA) (z=1), triethylene tetramine (TETA) (z=2), and tetraethylene pentamine (TETA) (z=3).

For products where z is greater than 3, the products are commonly referred to as "polyamine" or PAM. The preferred products of this invention employ diethylene triamine, triethylene tetramine, tetraethylene pentamine, "polyamine" or mixtures thereof.

The carboxylic acid or anhydride reactant of the above reaction product is characterized by compounds of structure VII and structure VIII and mixtures thereof:

Structure VII

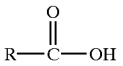

Structure VIII

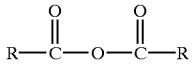

where R is a straight or branched chain, saturated or unsaturated, aliphatic hydrocarbyl radical containing from 9 to 29 carbon atoms, preferably from 11 to 23 carbon atoms. When R is a branched chain group, no more than 25% of the carbon atoms are in side chain or pendent groups. R is preferably derived from stearic, isostearic or oleic acids.

The hydrocarbyl group R includes predominantly hydrocarbyl groups as well as purely hydrocarbyl groups. The term "predominantly hydrocarbyl" group as used herein means that the group contains no non-hydrocarbyl substituents or non-carbon atoms that significantly affect the hydrocarbyl characteristics or properties of such groups relevant to their uses as described here. For example, a purely hydrocarbyl $C_{20}$ alkyl group and a $C_{20}$ alkyl group substituted with a methoxy substituent are substantially similar in their properties and would be considered hydrocarbyl within the context of this disclosure.

Examples of substituents that do not significantly alter the hydrocarbyl characteristics or properties of the general nature of the hydrocarbyl groups of the carboxylic acid or anhydride are:

Ether groups (especially hydrocarbyloxy such as phenoxy, benzyloxy, methoxy, n-isotoxy, etc., particularly alkoxy groups of up to ten carbon atoms); oxo groups (i.e., —O— linkages in the main carbon chain); ester groups (i.e., —C(O)—O-hydrocarbyl); sulfonyl groups (i.e., —$SO_2$-hydrocarbyl); and sulfinyl groups (i.e., —SO-hydrocarbyl).

A preferred embodiment is when $R_5$ and $R_6$ are derived from isostearic acid and the polyamine is tetraethylene pentamine.

While any effective amount of the amide friction modifier may be used to achieve the benefits of the invention, typically effective amounts will be from about 0.01 to 5.0 mass percent in the finished lubricant. Preferably dosages will be from about 0.01 to 3.0 mass percent and more preferably from about 0.01 to 1.0 mass percent.

EXAMPLE FM-1-A

Into a suitable reaction vessel equipped with a stirrer, nitrogen sparger and condenser, was placed 450 grams (1.57 mol) of isostearic acid. The stirrer was started, the flask flushed with nitrogen and heated to approximately 110° C., at which time 189 grams (approximately 1 mol) of tetraethylene pentamine (TEPA) was added dropwise. When the addition of the TEPA was completed, an additional 450 grams (1.57 mol) of isostearic acid was slowly added. The temperature of the reaction mass was slowly raised and the water of condensation collected overhead. When water production slowed, a nitrogen sparge was begun and a slight vacuum applied to the system. By the time the temperature reached 200° C., the reaction was complete. The entire process took approximately 5 hours. The product was cooled, filtered and analyzed. It was found to contain 6.4% nitrogen.

EXAMPLE FM-1-B

The procedure above was repeated except that oleic acid, 890 grams, was substituted for the isostearic acid. The product was analyzed and found to contain 6.4% nitrogen.

(2) Succinimides

The succinimide friction modifiers of the current invention are compounds having the structure IV:

Structure IV

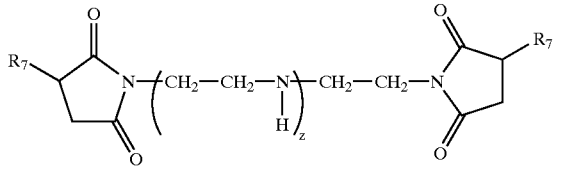

wherein $R_7$ is $C_6$ to $C_{30}$ alkyl, and z=1 to 10.

The alkenyl succinic anhydride starting materials for forming the friction modifiers of structure IV can be either of two types. The two types differ in the linkage of the alkyl side chain to the succinic acid moiety. In the first type, the alkyl group is joined through a primary carbon atom in the starting olefin, and therefore the carbon atom adjacent to the succinic acid moiety is a secondary carbon atom. In the second type, the linkage is made through a secondary carbon atom in the starting olefin and these materials accordingly have a branched or isomerized side chain. The carbon atom adjacent to the succinic acid moiety therefore is necessarily a tertiary carbon atom.

The alkenyl succinic anhydrides of the first type, shown as structure IX, with linkages through secondary carbon atoms, are prepared simply by heating α-olefins, that is, terminally unsaturated olefins, with maleic anhydride. Examples of these materials would include n-decenyl succinic anhydride, tetradecenyl succinic anhydride, n-octadecenyl succinic anhydride, tetrapropenyl succinic anhydride, etc.

Structure IX

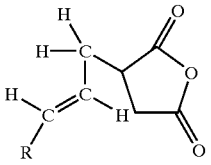

wherein R is $C_3$ to $C_{27}$ alkyl.

The second type of alkenyl succinic anhydrides, with linkage through tertiary carbon atoms, are produced from internally unsaturated olefins and maleic anhydride. Internal olefins are olefins which are not terminally unsaturated, and therefore do not contain the

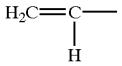

moiety. These internal olefins can be introduced into the reaction mixture as such, or they can be produced in situ by exposing α-olefins to isomerization catalysts at high temperatures. A process for producing such materials is described in U.S. Pat. No. 3,382,172. The isomerized alkenyl substituted succinic anhydrides are compounds having structure X:

Structure X

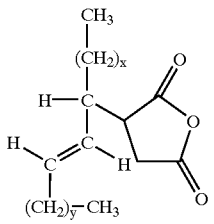

where x and y are independent integers whose sum is from 1 to 30.

The preferred succinic anhydrides are produced from isomerization of linear α-olefins with an acidic catalyst followed by reaction with maleic anhydride. The preferred α-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The alkenyl succinic anhydrides are then further reacted with polyamines of structure VI. The preferred succinimide friction modifiers of this invention are products produced by reacting the isomerized alkenyl succinic anhydride with diethylene triamine, triethylene tetramine, tetraethylene pentamine or mixtures thereof. The most preferred products are prepared using tetraethylene pentamine. The alkenyl succinic anhydrides are typically reacted with the amines in a 2:1 molar ratio so that both primary amines are converted to succinimides. Sometimes a slight excess of isomerized alkenyl succinic anhydride is used to insure that all primary amines have reacted. The products of the reaction are compound of structure IV.

The two types of succinimide friction modifiers can be used individually or in combination.

The disuccinimides of structure IV may be post-treated or further processed by any number of techniques known in the art. These techniques would include, but are not limited to, boration, maleation, and acid treating with inorganic acids such as phosphoric acid, phosphorous acid, and sulfuric acid. Descriptions of these processes can be found in, for example, U.S. Pat. No. 3,254,025; U.S. Pat. No. 3,502,677; U.S. Pat. No. 4,686,054; and U.S. Pat. No. 4,857,214.

Another useful derivative of the succinimide modifiers are where the alkenyl groups of structures IV, IX and X have been hydrogenated to form their saturated alkyl analogs. Saturation of the condensation products of olefins and maleic anhydride may be accomplished before or after reaction with the amine. These saturated versions of structures IV, IX and X may likewise be post-treated as previously described.

While any effective amount of the compound s of structure IV and its derivatives may be used to achieve the benefits of this invention, typically these effective amounts will range from 0.5 to 10 weight percent of the finished fluid, preferably from 1 to 7 weight percent, most preferably from 2 to 6 weight percent.

Examples of methods for producing compounds having structure IV are given below.

EXAMPLE FM-2-A

Into a one liter round bottomed flask fitted with a mechanical stirrer, nitrogen sweep, Dean Starke trap and condenser was placed 352 grams (1.00 mol) of isooctadecenylsuccinic anhydride (ODSA obtained from the Dixie Chemical Co.). A slow nitrogen sweep was begun, the stirrer started and the material heated to 130° C. Immediately, 87 grams (0.46 mol) of commercial tetraethylene pentamine was added slowly through a dip tube to the hot stirred isooctadecenylsuccinic anhydride. The temperature of the mixture increased to 150° C. where it was held for two hours. During this heating period 8 mL of water (~50 of theoretical yield) was collected in the Dean Starke trap. The flask was cooled to yield the product and the product weighed and analyzed. Yield: 427 grams. Percent nitrogen: 7.2.

EXAMPLE FM-2-B

The procedure of Example FM-2-A was repeated except that the following materials and amounts were used: n-octadecenylsuccinic anhydride, 352 grams (1.0 mol) and tetraethylene pentamine, 87 grams (0.46 mol). The water recovered was 8 mL. Yield: 430 grams. Percent nitrogen: 7.1.

EXAMPLE FM-2-C

The procedure of Example FM-2-A was repeated except that the following materials and amounts were used: isooctadecenylsuccinic anhydride, 458 grams (1.3 mol) and diethylenetriamine, 61.5 grams (0.6 mol). The water recovered was 11 mL. Yield: 505 grams. Percent nitrogen: 4.97.

EXAMPLE FM-2-D

The procedure of Example FM-2-A was repeated except that the following materials and amounts were used: isohexadecenylsuccinic anhydride (ASA-100 obtained from the Dixie Chemical Co.), 324 grams (1.0 mol), and tetraethylenepentamine, 87 grams (0.46 mol). The water recovered was 9 mL. Yield: 398 grams. Percent nitrogen: 8.1.

EXAMPLE FM-2-E

The product of Example FM-2-A, 925 grams (1.0 mol), and 140 grams of a naphthenic base oil (sold under the trademark Necton-37® and available from Exxon Chemical Co.) and 1 gram of anti-foamant DC-200 sold by Dow Corning were placed in a 2 liter round bottomed flask fitted with a heating mantle, an overhead stirrer, a nitrogen sweep, a Dean Starke trap and a condenser. The solution was heated to 80° C. and 62 grams (1.0 mol) of boric acid was added. The mixture was heated to 140° C. and held at this temperature for 3 hours. During this heating period 3 mL of water was collected in the Dean Starke trap. The product was cooled, filtered, weighed, and analyzed. Yield: 1120 grams. Percent nitrogen: 6.1; percent boron: 0.9.

(3) Ethoxylated Amines

The ethoxylated amine friction modifiers of the current invention are compounds having structure V:

Structure V

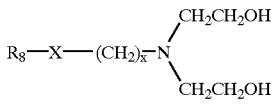

wherein $R_8$ is a $C_6$ to $C_{28}$ alkyl group, X is O, S or $CH_2$, and x=1 to 6.

Alkoxylated amines are a particularly suitable type of friction modifier for use in this invention. Preferred amine compounds contain a combined total of from about 18 to about 30 carbon atoms. In a particularly preferred embodiment, this type of friction modifier is characterized by structure V where X represents oxygen, $R_8$ contains a total of 18 carbon atoms, and x=3.

Preparation of the amine compounds, when X is oxygen and x is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90–150° C.

Another method of preparing the amine compounds, when X is oxygen and x is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and x is 1, the amine friction modifying compounds can be formed, for example, by effecting a conventional free radical reaction between a long chain α-olefin with a hydroxyalkyl mercaptan, such as β-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and x is 1, the present amine friction modifiers are well known in the art and are described in, for example, U.S. Pat. Nos. 3,186,946, 4,170,560, 4,231,883, 4,409,000 and 3,711,406.

Examples of suitable amine compounds include, but are not limited to, the following: N,N-bis(2-hydroxyethyl)-n-dodecylamine; N,N-bis(2-hydroxyethyl)-1-methyltridecenylamine; N,N-bis(2-hydroxyethyl)-hexadecylamine; N,N-bis(2-hydroxyethyl)-octadecylamine; N,N-bis(2-hydroxyethyl)-octadecenylamine; N,N-bis(2-hydroxyethyl)-oleylamine; N-(2-hydroxyethyl)-N-(hydroxyethoxyethyl)-n-dodecylamine; N,N-bis(2-hydroxyethyl)-n-dodecyloxyethylamine; N,N-bis(2-hydroxyethyl)-dodecylthioethylamine; N,N-bis(2-hydroxyethyl)-dodecylthiopropylamine; N,N-bis(2-hydroxyethyl)-hexadecyloxypropylamine; N,N-bis(2-hydroxyethyl)-hexadecylthiopropylamine; N-2-hydroxyethyl,N-[N',N'-bis (2-hydroxyethyl)ethylamine]-octadecylamine; and N-2-hydroxyethyl,N-[N',N'-bis(2-hydroxyethyl)ethylamine]-stearylamine.

The most preferred additive is N,N-bis(2-hydroxyethyl)-hexadecyloxypropylamine which is sold by the Tomah Chemical Co. under the designation E-22-S-2.

The amine compounds may be used as such, however, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

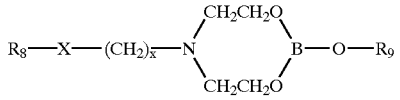

where $R_8$, X, and x are the same as previously defined for structure V and where $R_9$ is either hydrogen or an alkyl radical.

Other additives known in the art may be added to the power transmitting fluids of this invention. These additives include dispersants, antiwear agents, corrosion inhibitors, metal detergents, extreme pressure additives, and the like. Such additives are disclosed in, for example, "Lubricant Additives" by C. V. Smalheer and R. Kennedy Smith, 1967, pp. 1–11 and U.S. Pat. No. 4,105,571.

The detergents include the metal salts of sulfonic acids, alkyl phenols, sulfurized alkyl phenols, alkyl salicylates, naphthenates and other oil soluble mono- and dicarboxylic acids. Highly basic (i.e., overbased) metal salts, such as highly basic alkaline earth metal sulfonates (especially Ca and Mg salts) are frequently used as detergents. They are usually produced by heating a mixture comprising an oil soluble sulfonate or alkaryl sulfonic acid, with an excess of alkaline earth metal compound above that required for complete neutralization of any sulfonic acid present, and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as, for example, haloparaffins, olefins that may be obtained by dehydrogenation of paraffins, and polyolefins such as, for example, polymers from ethylene or propylene. The alkaryl sulfonates usually contain from about 9 to about 70 more carbon atoms, preferably from about 16 to about 50 carbon atoms per alkyl substituted aromatic moiety. The most preferred ash-producing detergents include calcium sulfonate, calcium phenate, magnesium sulfonate, and magnesium phenate.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to about 220%, although it is preferred to use at least 125%, of the stoichiometric amount of metal required for complete neutralization.

Dispersants maintain oil insolubles, resulting from oxidation during use, in suspension in the fluid, thus preventing sludge flocculation and precipitation. Suitable dispersants include, for example, dispersants of the ash-producing or ashless type, the latter type being preferred.

Ashless dispersants, which are the preferred dispersant for use in connection with this invention, are so called despite the fact that, depending on their constitution, the dispersant may upon combustion yield a non-volatile material such as boric oxide or phosphorus pentoxide. Ashless dispersants, however, ordinarily do not contain metal and therefore do not yield a metal-containing ash on combustion. Many types of ashless dispersants are known in the art and, as any of them are suitable for use in the lubricant compositions of this invention, the following examples are only illustrative.

Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described, for example, in British Pat. Nos. 1,306,529, 3,272,746, 3,341,542, 3,454,607 and 4,654,403.

Nitrogen- or ester-containing ashless dispersants comprise members selected from the group consisting of oil soluble salts, amides, imides, oxazolines and esters, or mixtures thereof, of long chain hydrocarbyl-substituted mono- and dicarboxylic acids or anhydride or ester derivatives thereof wherein the long chain hydrocarbyl group is a polymer, typically of a $C_2$ to $C_{10}$ monoolefin, the polymer having a number average molecular weight of from about 700 to 5000.

The long chain hydrocarbyl-substituted dicarboxylic acid material which can be used to make the dispersant includes the reaction product of long chain hydrocarbon polymer, generally a polyolefin, with (i) monounsaturated $C_4$ to $C_{10}$ dicarboxylic acid wherein (a) the carboxyl groups are vicinyl, (i.e., located on adjacent carbon atoms) and (b) at least one, preferably both, of the adjacent carbon atoms are part of the monounsaturation; or with (ii) derivatives of (i) such as anhydrides or $C_1$ to $C_5$ alcohol derived mono- or diesters of (i). Upon reaction with the hydrocarbon polymer, the monounsaturation of the dicarboxylic acid material becomes saturated. Thus, for example, maleic anhydride becomes a hydrocarbyl-substituted succinic anhydride.

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art, see, e.g., U.S. Pat. Nos. 3,254,025, 3,502,677 and 4,857,214.

Representative amounts of these additives in an ATF are summarized as follows:

| Additive | Broad Wt. % | Preferred Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

The additive combinations of this invention may be combined with other desired lubricating oil additives to form a concentrate. Typically the active ingredient (a.i.) level of the concentrate will range from 20 to 90 weight percent of the concentrate, preferably from 25 to 80 weight percent, most preferably from 35 to 75 weight percent. The balance of the concentrate is a diluent typically comprised of a lubricating oil or solvent.

Table 1 contains oil compositions illustrative of the present invention. All of the amounts of materials shown in Table 1 are in mass percentages. The "Base Oil" shown in Table 1 contains required levels of corrosion inhibitors, anti-foamant and viscosity modifiers.

The composition shown in Table 1 as Example E was subjected to two critical performance tests: (1) an FZG gear scoring test according to ASTM D-5182; and (2) a steel-on-steel friction evaluation. Also, evaluated in these tests was a commercial lubricant used as a factory fill oil for continuously variable transmissions. The results of these tests are given in Table 2.

The FZG gear test results show the superior anti-wear performance provided by the compositions of the present invention as exemplified by the product of Example E of Table 1. Improved performance is measured as higher load stages "to fail" the test. The product of Example E protected the gears against scuffing and seizure significantly better than the commercial lubricant.

The steel-on-steel friction test is performed by loading a CVT belt element against an oscillating steel ring immersed in the test lubricant. The friction coefficient is measured as a function of speed and temperature. The results in Table 2 show the superior steel-on-steel friction characteristics of the compositions of the present invention as exemplified by the product of Example E of Table 1 when compared to the commercial CVT factory fill fluid. In CVT systems, a higher dynamic friction coefficient is better, as is lower static friction coefficient, as long as the static coefficient remains above the dynamic coefficient. The product of Example E is clearly directionally better in both of these criteria when compared to the current factory fill product.

Specific features and examples of the invention are presented for convenience only, and other embodiments according to the invention may be formulated that exhibit the benefits of the invention. These alternative embodiments will be recognized by those skilled in the art from the teachings of the specification and are intended to be embraced within the scope of the appended claims.

What is claimed is:

1. A lubricating composition for lubricating a continuously variable transmission, the lubricating composition comprising a mixture of:

(1) a major amount of a lubricating oil; and (2) an effective amount of a continuously variable transmission performance enhancing additive combination comprising:

(a) at least one organic phosphite selected from the group consisting of

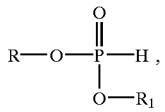

where R is hydrocarbyl and $R_1$ is hydrocarbyl or hydrogen, and

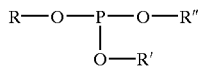

where R, R', and R" are hydrocarbyl;

(b) at least one amine salt of an organic phosphate having the structure

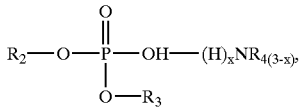

wherein $R_2$ and $R_3$ are alkyl or aryl, and further $R_3$ may be H, and $R_4$ is alkyl; and (c) one or more friction modifiers selected from the group consisting of:

(1) amides having the structure

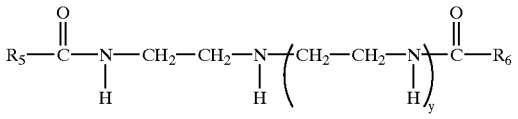

wherein $R_5$ and $R_6$ are independently $C_9$ to $C_{29}$ alkyl groups, and y=1 to 10, (2) succinimides having the structure

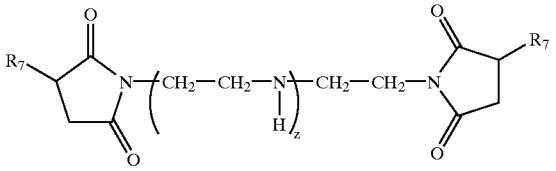

wherein $R_7$ is $C_6$ to $C_{30}$ alkyl, and z=1 to 10, and (3) ethoxylated amines having the structure

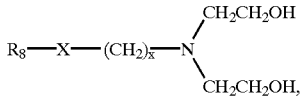

wherein $R_8$ is a $C_6$ to $C_{28}$ alkyl group, X is O, S or $CH_2$, and x=1 to 6 or the reaction product of an ethoxylated amine with a boron compound, the reaction product having the structure:

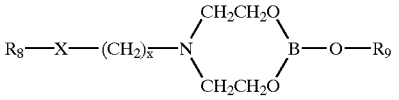

where $R_8$ is a $C_6$ to $C_{28}$ alkyl group, $R_9$ is either hydrogen or an alkyl radical, X is O, S or $CH_2$, and x=1 to 6.

2. The lubricating composition of claim 1, wherein the organic phosphite has R groups selected from the group consisting of decyl, undecyl, 3-thiaundecyl, pentadecyl and 3-thiapentadecyl.

3. The lubricating composition of claim 1, wherein the amine salt of an organic phosphate is derived from a compound selected from the group consisting of 1-octanol, 2-ethyl-hexyl alcohol, 1-decanol, 1-dodecanol, 1-hexadecanol, 3-thianonanol, 3-thiaundecanol, and 3-thiapentadecanol.

4. The lubricating composition of claim 1, wherein the friction modifier is the amide derived from an amine having the structure:

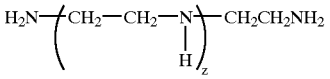

where z is an integer from 1 to 10.

5. The lubricating composition of claim 4, wherein the amine is selected from a group consisting of diethylene triamine (DETA), triethylene tetramine (TETA), and tetraethylene pentamine (TETA).

6. The lubricating composition of claim 1, wherein the friction modifier is the ethoxylated amine where X is oxygen, $R_8$ contains a total of 18 carbon atoms, and x=3.

7. The lubricating composition of claim 6, wherein the ethoxylated amine is N,N-bis(2-hydroxyethyl) hexadecyloxypropylamine.

8. The lubricating composition of claim 1, wherein the friction modifier is the reaction product of the ethoxylated amine and a boron compound.

9. The lubricating composition of claim 1, containing an amide friction modifier and an ethoxylated amine friction modifier.

10. The lubricating composition of claim 1 containing an amide friction modifier, a succinimide friction modifier and an ethoxylated amine friction modifier.

11. The lubricating composition of claim 1, wherein the lubricating oil contains a synthetic base oil.

12. The lubricating composition of claim 1, further comprising:

an effective amount of a metallic detergent.

13. The lubricating composition of claim 12, wherein the metallic detergent is selected from the group consisting of: calcium sulfonate, calcium phenate, magnesium sulfonate, and magnesium phenate.

14. The lubricating composition of claim 1, further comprising:

an effective amount of an ashless dispersant.

15. The lubricating composition of claim 14, wherein the ashless dispersant is a polyisobutylene succinimide reacted with a alkylene polyamine.

16. A continuously variable transmission performance-enhancing additive composition comprising a mixture of:

(a) at least one organic phosphite selected from the group consisting of

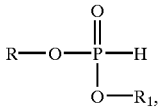

where R is hydrocarbyl and $R_1$ is hydrocarbyl or hydrogen, and

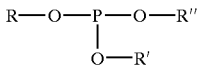

where R, R', and R" are hydrocarbyl;

(b) at least one amine salt of an organic phosphate having the structure

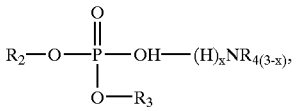

wherein $R_2$ and $R_3$ are alkyl or aryl, and further $R_3$ may be H, and $R_4$ is alkyl; and (c) one or more friction modifiers selected from the group consisting of:

(1) amides having the structure

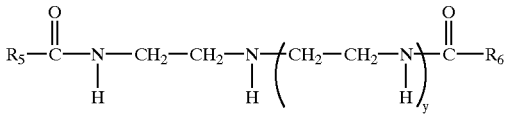

wherein $R_5$ and $R_6$ are independently $C_9$ to $C_{29}$ alkyl groups, and y=1 to 10, (2) succinimides having the structure

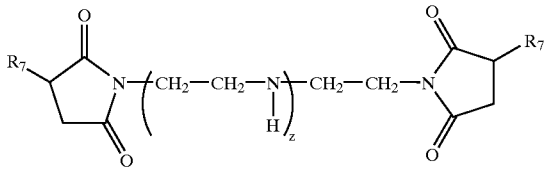

wherein $R_7$ is $C_6$ to $C_{30}$ alkyl, and z=1 to 10, and (3) ethoxylated amines having the structure

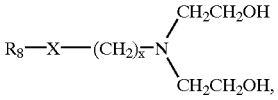

wherein $R_8$ is a $C_6$ to $C_{28}$ alkyl group, X is O, S or $CH_2$, and x=1 to 6.

17. The additive of claim 16, wherein the components are blended at temperatures above 100° C.

18. A method of lubricating a continuously variable transmission using the lubricating composition of claim 1 which comprises adding the lubricating composition of claim 1 to the transmission.

* * * * *

UNITED STATES PATENT AND TRADEMARK OFFICE

CERTIFICATE OF CORRECTION

PATENT NO. : 6,613,722 B1
DATED : September 2, 2003
INVENTOR(S) : R.F. Watts et al.

It is certified that error appears in the above-identified patent and that said Letters Patent is hereby corrected as shown below:

Column 18,
Line 34, change "(TETA)" to -- (TEPA) --.

Signed and Sealed this

Thirtieth Day of December, 2003

JAMES E. ROGAN
*Director of the United States Patent and Trademark Office*